US005316345A

United States Patent [19]

Madison

[11] Patent Number: 5,316,345

[45] Date of Patent: May 31, 1994

[54] SINGLE PANEL COMMUNICATION CARD AND ITS COLOR METHOD

[76] Inventor: Roberta E. Madison, P.O. Box 24483, Nashville, Tenn. 37202

[21] Appl. No.: 74,729

[22] Filed: Jun. 10, 1993

Related U.S. Application Data

[63] Continuation of Ser. No. 904,829, Jun. 26, 1992, abandoned.

[51] Int. Cl.[5] ..... B42D 15/00

[52] U.S. Cl. ..... 283/117; 283/56; 283/81; 283/101; 283/106

[58] Field of Search ..... 253/56, 81, 101, 106, 253/117

[56] References Cited

U.S. PATENT DOCUMENTS

| | | | |
|---|---|---|---|
| 1,875,804 | 9/1932 | Dicicco | 229/92.8 |
| 3,762,630 | 10/1973 | Braznell | 229/92.8 |
| 3,986,283 | 10/1976 | Pelaez | 40/125 A |
| 4,070,778 | 1/1978 | Mahler | 40/124.1 |
| 4,278,199 | 7/1981 | Tanaka | 283/101 X |
| 4,598,860 | 7/1986 | Pennock | 283/106 X |
| 4,872,705 | 10/1989 | Hartfeil | 283/67 |
| 4,907,826 | 3/1990 | Versage | 283/56 |
| 4,938,414 | 7/1990 | Lippert | 229/92.8 |
| 4,997,126 | 3/1991 | Amoss | 229/92.8 |

FOREIGN PATENT DOCUMENTS

| | | | |
|---|---|---|---|
| 24120 | of 1899 | United Kingdom | 229/92.8 |

OTHER PUBLICATIONS

Picture post card from Argus Communications-1992.

*Primary Examiner*—Paul A. Bell

*Attorney, Agent, or Firm*—I. C. Waddey, Jr.

[57] ABSTRACT

A single panel communication card whose principal function is social expression. The card comprises a card body having a front face, a back face, and no fold; multicolor graphic images of social expression imprinted on the front and back faces; and an exposed surface upon which identifying indicia may be applied. The exposed surface is divided into predetermined regions of specified light reflectance and fluorescence requirements. All colors and images used within these regions are designed to meet the appropriate light reflectance and fluorescence requirements. This enables the exposed surface to be read by light sensitive postal equipment; even when bright and dark colors are present. Prior to mailing the card, the sender signs his/her name, then applies the address and proper postage.

43 Claims, 10 Drawing Sheets

FIG. 1

| Card Type | Primary Function | Basic Structure | Multi-Color Graphics | Steps of Operation | Stamp Cost |
|---|---|---|---|---|---|
| A ANNOUNCEMENT | proclaim event (imprinted by special order) | single panel (envelope) | none | 1) stuff envelope<br>2) seal<br>3) address<br>4) stamp | 29¢ |
| B POSTAL CARD | correspondence (handwritten) | single panel—imprinted stamp | none | 1) write letter<br>2) sign<br>3) address<br>4) stamp | 19¢ |
| C POST CARD | correspondence (handwritten) | single panel | none | 1) write letter<br>2) sign<br>3) adddress<br>4) stamp | 19¢ |
| D PICTURE POST CARD | correspondence (handwritten) | single panel | 1 side of card | 1) write letter<br>2) sign<br>3) address<br>4) stamp | 19¢ |
| E FIRST PREFERRED EMBODIMENT | social expression (imprinted) | single panel—color structure | both sides of card | 1) sign<br>2) address<br>3) stamp | 19¢ |
| F GREETING CARD | social expression (imprinted) | multi-panel (envelope) | 1 side of card | 1) sign<br>2) stuff envelope<br>3) address<br>4) seal<br>5) stamp | 29¢ |
| G NOTE CARD | correspondence (handwritten) | multi-panel (envelope) | 1 side of card | 1) write letter<br>2) sign<br>3) stuff envelope<br>4) address<br>5) seal<br>6) stamp | 29¢ |
| H THANK YOU CARD | express gratitude (handwritten) | multi-panel (envelope) | 1 side of card | 1) write letter<br>2) sign<br>3) stuff envelope<br>4) address<br>5) seal<br>6) stamp | 29¢ |
| I INVITATION | to invite (handwritten) | multi-panel (envelope) | 1 side of card | 1) write info.<br>2) stuff envelope<br>3) address<br>4) seal<br>5) stamp | 29¢ |
| J SELF-MAILER | correspondence (handwritten) | multi-panel | 1 side of card | 1) write letter<br>2) sign<br>3) address<br>4) seal | 29¢ |

SINGLE PANEL COMMUNICATION CARD AND ITS COLOR METHOD

This application is a continuation of application number 07/904,829, filed Jun. 26, 1992, now abandoned.

FIELD OF INVENTION

This invention relates generally to mailing cards such as post cards, and, more particularly, to a single panel communication card whose principal function is social expression.

BACKGROUND: PRIOR ART

In the United States alone, the number of social expression cards sent annually averages 28 cards per man, woman, and child. At an estimated cost of $1.50 per card with present postage of 29¢ per card, the yearly expenditures could top $50 per person. For a family of four, the costs could exceed $200 per year. Increased card costs and postage rates would take this number even higher. Consequently, people have become more selective about who they send cards to; particularly at holiday times, when the expense is most apparent. Although there are many choices when selecting social expression cards such as greeting cards, there are few choices when it comes to their costs.

A major cost in card production is paper. Greeting cards have two or more panels, each additional panel requiring more paper and another score line. Envelope costs can also be staggering; as they often require more paper than the cards themselves. These combined costs are all passed onto the consumer, manifesting themselves in the following disadvantages:

(a) The cumulative costs for greeting cards and postage can be expensive over a year's time.

(b) Trees used to make paper are limited resources. The further reduction of these resources cause paper prices to soar. When one considers that most cards and envelopes are ultimately discarded, their cumulative wastes is alarming. Although much paper is recycled, it is an expensive process; particularly for resources used unnecessarily in the first place.

(c) The discarded paper that is not recycled adds to the mountains of environmental wastes.

Heretofore, an alternative for consumers has been the personal post card. Webster's Dictionary defines a post card as a "card prepared for correspondence on one section or side, and address on the other." Webster's defines correspondence as "communication by letter."

For over one hundred years, inventors have varied the graphics, structure, and operation of the post card. However, since its inception, correspondence, the principal function of the post card, has remained unchanged. In United Kingdom patent 24,120 to Attinger (1899), he discloses writing sheets and cards upon which messages can be written. In U.S. Pat. No. 3,986,283 to Pelaez (1976), he describes a novelty post card with a space for the "usual message".

U.S. Pat. No. 4,070,778 to Mahler (1978), he discloses a combination greeting card and post card with standard indicia for the written message. In U.S. Pat. No. 4,997,126 to Hartfeil (1989), he describes a post card for sending confidential messages. Every embodiment of the personal post card heretofore known includes indicia or space for the written message.

Though post cards are cost and paper savers, they are inadequate substitutes for social expression cards. The consumers who attempt to use them in this capacity are faced with further disadvantages:

(d) The sender is required to write a letter. Although some post cards bear a greeting, their principal function is correspondence. Therefore what is gained in cost savings is lost in effort.

(e) Inherently, the use of a post card compromises the convenience and eloquence of the pre-printed verses that appear on social expression cards. Consequently, the quality of the message is limited to the writing skills of the sender. What is gained in cost savings is lost in convenience and often quality.

(f) Inherently, post cards are more time consuming to prepare. Imagine writing 28 different post cards for Christmas, personalizing each one. What is gained in cost savings is lost in time.

(g) Due to their white porous background for writing, post cards have an unfinished look. What is gained in cost savings is lost in appearance.

Consumers want a social expression card that saves these varied costs to themselves and the environment. What they seek is a communication card that prior art heretofore known has not provided.

The ideal would be a beautiful and colorful single panel card that requires no envelope, and can be mailed at the first class card rate of 19¢. In this crowded field, one wonders why prior art has not provided such a card.

In addition to non-recognition of the problem, there is one major obstacle to the creation of such a card: Color. Prior art teaches away from the use of bright or dark colors on the address side of personal mailing cards, and mail pieces in general. The U.S. Postal Service states that only light colored cards and envelopes should be used. It further warns against the use of brilliant colors due to the scanner's inability to read them.

It is not that brilliant colors have never been used on mailing pieces, it is that they have not been used effectively. For years greeting card companies have used bright red envelopes with their Christmas cards, only to have them rejected by automated equipment. Therefore hundreds of millions of Christmas cards have had to be sorted by hand; a postal worker's nightmare. This practice is being amended, as companies are starting to use pastel colored envelopes with their holiday cards. Colors have also been attempted on post cards, with insufficient results. In U.S. Pat. No. 4,938,414 to Lippert (1990), he discloses a post card for hidden messages, wherein colored inks can be used on the address side. However, his use of color is confined to a rectangle in the upper left corner; reserved for a small photo, advertisement, or message. This is deemed an unsatisfactory solution to the color problem, given its obvious limitations.

The ineffective use of color has resulted in further disadvantages:

(h) Use of intense colors on mail pieces has resulted in rejection by automated postal equipment.

(i) Limited use of color on mail pieces has hindered artistic appeal.

INVENTION SUMMARY

According to the invention, "social" has to do with people, relationships, or activities of society; an "expression" is a symbolization or representation in art; and a single panel is a surface with no fold.

The invention combines art and science to create a single panel social expression card that saves the consumer money, time, and effort without sacrificing artistry, quality, or convenience. Several objects and advantages are:

(a) to provide a card at a low cost to consumers;
(b) to provide a card that minimizes materials, thereby preserving resources;
(c) to provide a card that minimizes materials, thereby reducing wastes and helping the environment;
(d) to provide a card whose graphic images serve as the principal means of communication between the sender and the recipient;
(e) to provide a card which the sender selects based upon the images that best express his own sentiments;
(f) to provide a card with short steps of operation;
(g) to provide a card with a finished look on both sides;
(h) to provide a card comprising multi-color images without impeding the function of light sensitive equipment;
(i) to provide a card with a colorful and appealing appearance.

Further objects and advantages are to provide a card which can be transferred independently, and whose preferred embodiments can be mailed at the reduced postage rate of 19¢. Still further objects and advantages will become apparent from a consideration of the ensuing description and drawings.

BRIEF DESCRIPTION OF FIGURES

In the drawings, closely related figures have the same number but different alphabetic suffixes.

FIG. 1 compares the invention to existing personal communication cards with regard to function, structure, graphics, operation, and postage rate.

REFERENCE LETTERS AND NUMERALS

40=card body
42=bar code area
44=address area
46=postage area
48=multi-color graphic images
50=signature
52*a*=coating(s) or treatment(s) on the front image
52*b*=coating(s) or treatment(s) on the back image
54=label
60=critical region
62*a*=non-critical region (front of card)
62*b*=non-critical region (back of card)
64=fluorescence scanning path
66=fluorescence safety region
ES=exposed surface
r=right edge of card
l=bottom of card
x=height
y=width Sectional views are taken along the y axis or width of card 40.

DESCRIPTION OF THE PREFERRED EMBODIMENTS

Overview: The Present Invention and Prior Art

In the crowded art of personal communication cards, even the slightest differences are significant. At present there are nine basic types of personal communication cards that consumers send through the mail: announcements; postal cards; post cards; picture post cards; greeting cards; note cards; thank you cards; invitations; and self-mailers.

Though all of these cards have similar qualities, each is differentiated from the others by its own unique combination of the following five elements: Function; Structure; Graphics; Operation; and Postage Rate.

FIG. 1 summarizes the basic features of the invention E according to the first preferred embodiment. The primary function of the invention is social expression. The basic structure is a single panel card, however, the imprinted colors are also structured, as will be explained later in FIGS. 5*a* and 5*b*. Both sides of the card have multi-color graphics or pictures. The card has three simple steps of operation before mailing: sign the card, write the address, and apply the stamp. Because there is no letter writing involved, the operation of the invention is significantly faster and easier than that of the postal card B, the post card C, the picture post card D, the note card G, the thank you card H, the invitation I, or the self-mailer J. The invention differs from the basic postal card, post card, and picture post card in all areas but postage rate. The invention differs from the basic greeting card F in all areas but function. The invention differs from the basic announcement A, and the other basic card types in all five areas.

Elements Of The Invention

As an article of manufacture, the invention comprises a single panel card body 40 having a front face and a back face onto which multi-color graphic images 48 of social expression are imprinted, and an exposed surface ES upon which identifying indicia may be applied.

Figure 2A:
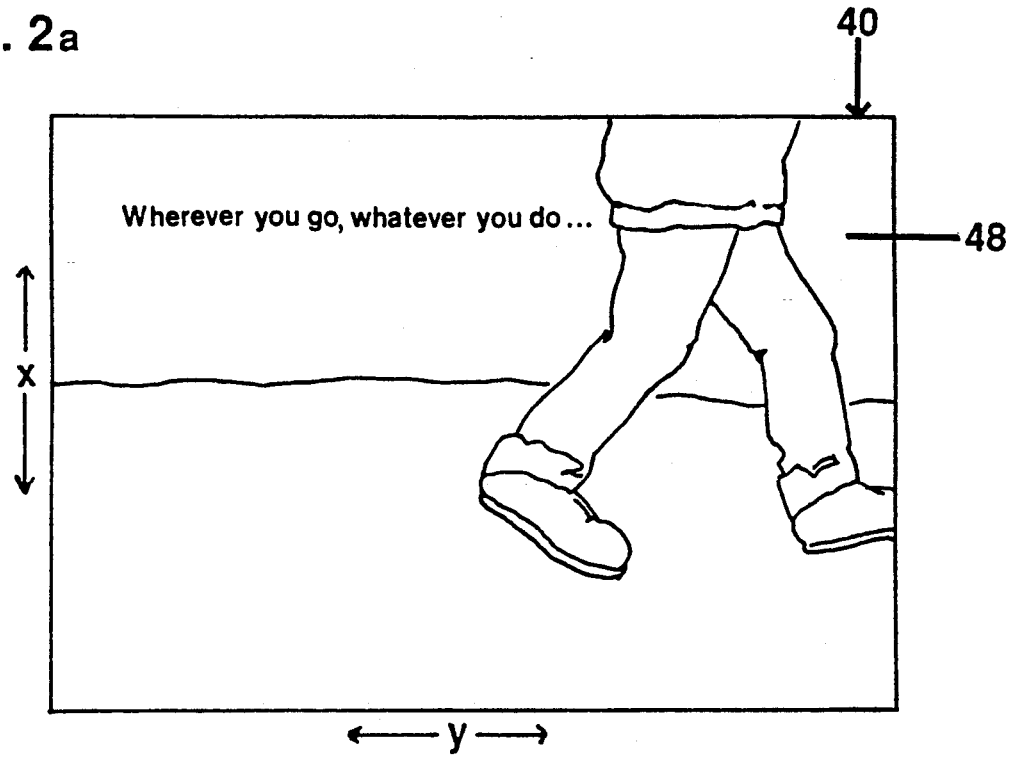
FIGS. 2*a* (front), 2*b* (back), and 2*c* (sectional) show a sample of the first preferred embodiment of the invention.

FIGS. 2*a* (front), 2*b* (back), and 2*c* (sectional) show an example of the first preferred embodiment. The card body 40 is formed from card stock or a similar material, having a thickness between 0.007 inches and 0.0095 inches; or the current thickness requirements for mailing cards as prescribed by the U.S. Postal Service. The card body 40 has no fold.

The card body 40 has a height x of no less than 3.5 inches and a width y of no less than 5 inches; or the current minimum permissible size for a mailing card as prescribed by the U.S. Postal Service regulations. In order to be acceptable for the First Class card rate, the height x should not exceed 4.25 inches and the width y should not exceed 6 inches; or the current maximum permissible size for a mailing card as prescribed by the U.S. Postal Service regulations. Of course, the card dimensions may exceed 4.25 inches by 6 inches, however, the enlarged size will require additional postage.

In the preferred embodiments described in FIGS. 2*a* through 11*d*, the height x and width y of the card body 40 are 4.25 inches and 6 inches, respectively. The regions and dimensions described in FIGS. 2*a* through 11*d* are based upon a card body of this size. It is understood that the invention is not limited to any of the dimensions set forth herein.

Figure 3A:
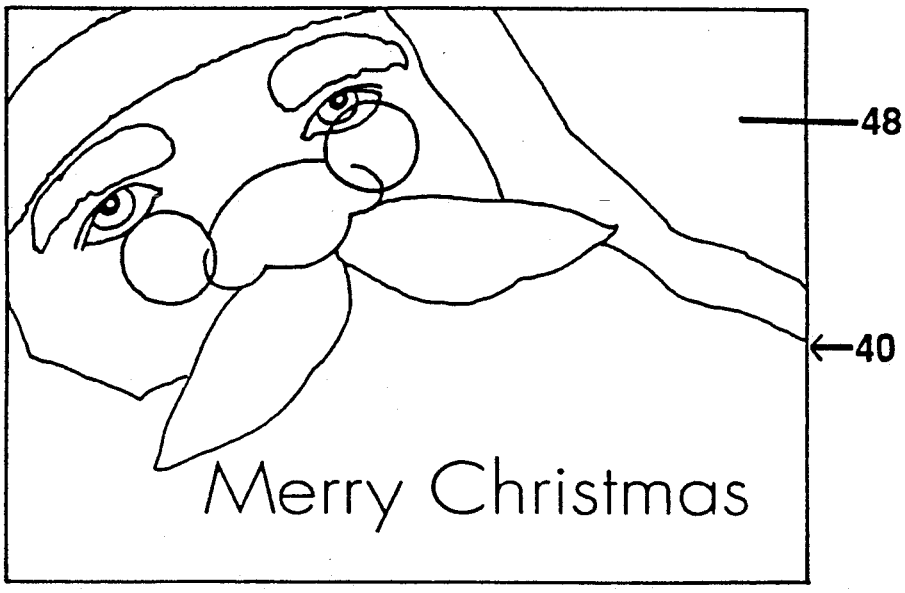
FIGS. 3*a* (front), 3*b* (back), and 3*c* (sectional) show a sample of the second preferred embodiment of the invention.
Figure 3B:
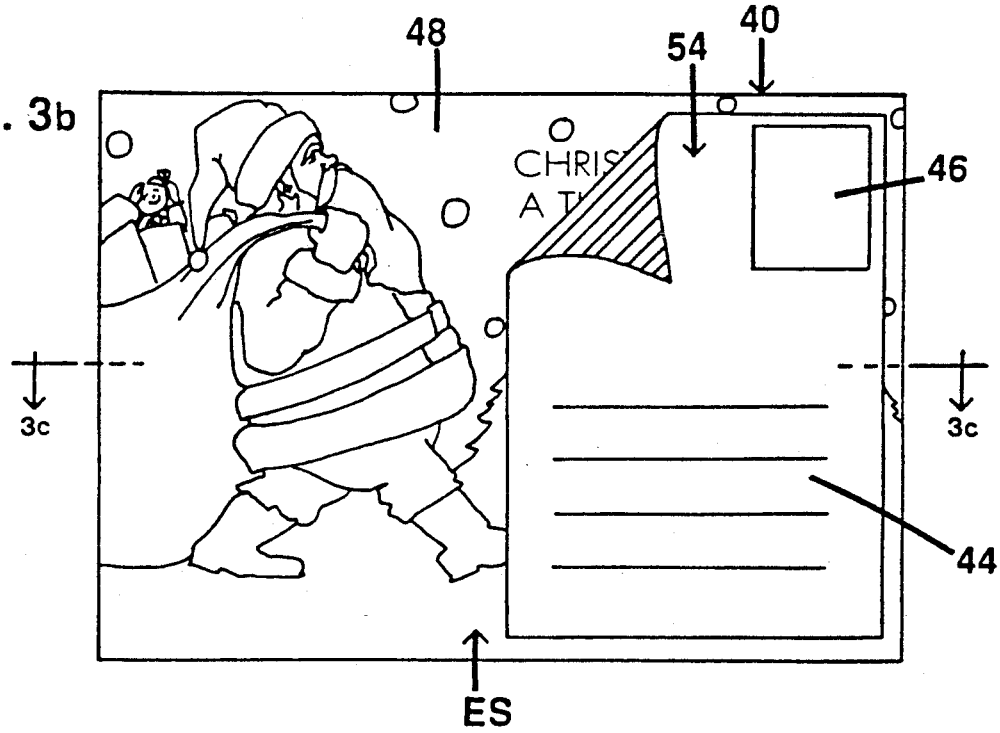
Figure 3C:
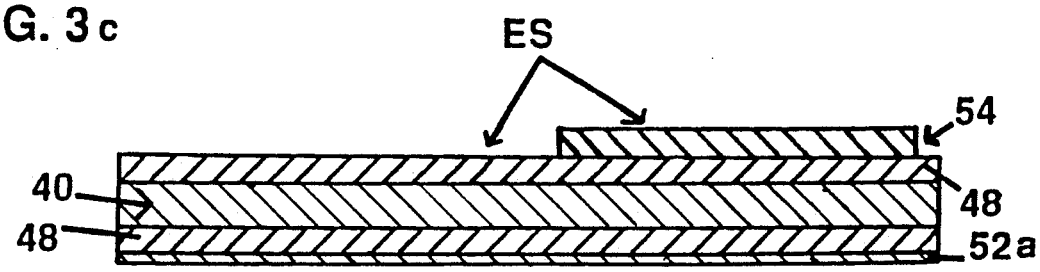
Figure 4A:
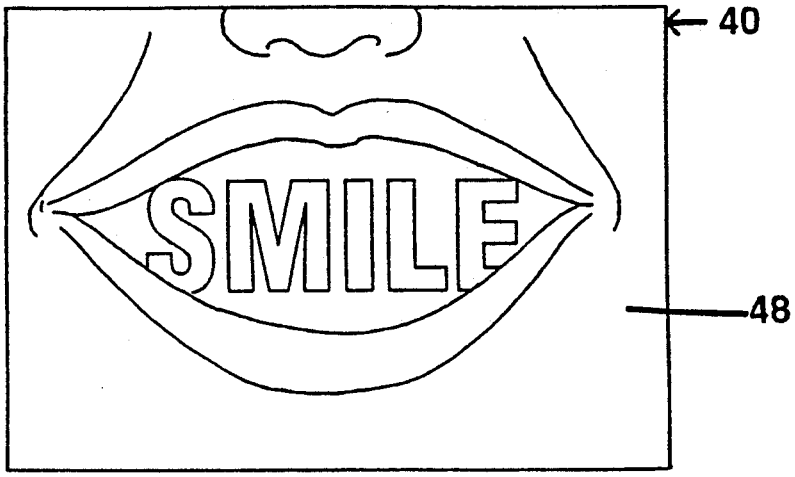
FIGS. 4*a* (front), 4*b* (back), 4*c* (exposed surface), and 4*d* (sectional) show a sample of the third preferred embodiment.
Figure 4B:
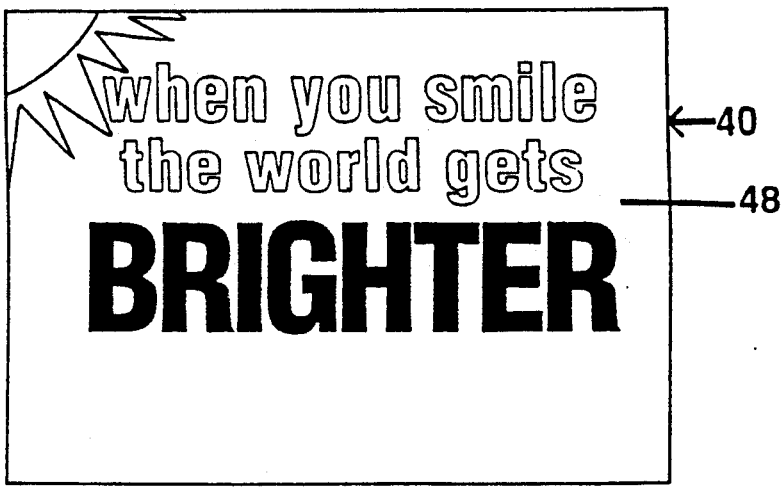

The front and back of the card body 40 have imprinted multi-color graphic images 48. These images comprise pictures and/or words. These images 48 have unified themes of social expression; that is, the artistic representation of relationships, thoughts, feelings, sentiments, beliefs, wishes, greetings, congratulations, occasions, holidays, events, stories, activities, salutations, happenings, or commentaries. For example, FIGS. 2*a* (front) and 2*b* (back) show an example of a card that expresses a relationship. FIGS. 3*a* (front) and 3*b* (back) show an example of a card that expresses holiday greetings. FIGS. 4*a* (front) and 4*b* (back) show an example of a card that expresses thought.

According to the invention, the images 48 themselves serve as the principal means of communication between the sender and the recipient; no letter writing is necessary. Therefore, in selecting a card, the sender simply chooses the one that best expresses his own sentiments.

Figure 2B:
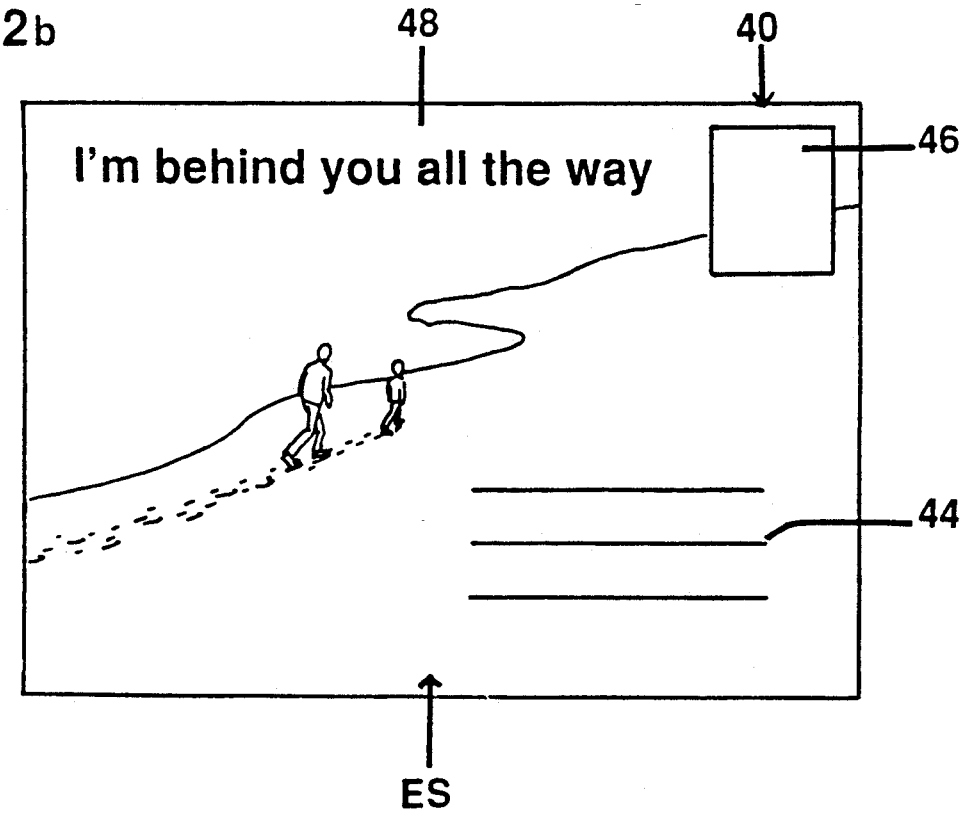
FIG. 2*d* (sectional) is a modified version of the first preferred embodiment.
Figure 2C:
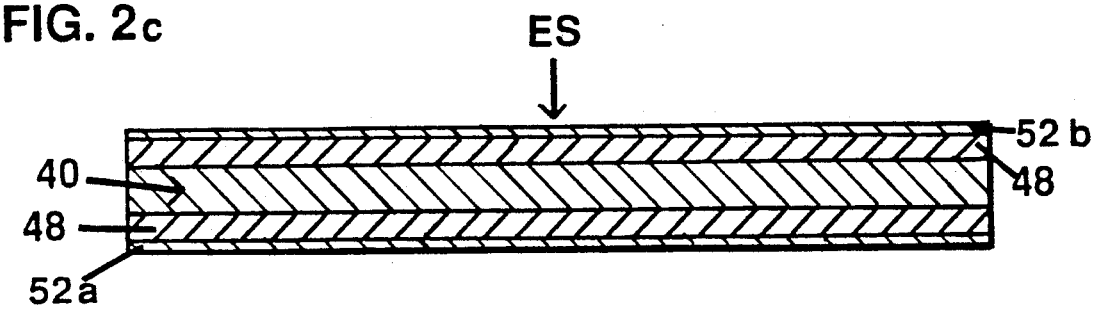

As in FIG. 2*c* (sectional) the front of the card 40 may have a coating 52*a* applied over the image 48 for protection. There are a number of suitable varnishes and resins for this purpose.

The back face of the card 40 bears an exposed surface ES upon which identifying indicia may be applied. In preferred embodiments the exposed surface ES serves as a vehicle to facilitate the transfer of the card from one party to another. The exposed surface ES may come in many forms.

In FIG. 2*b* (back) the surface ES has predetermined areas for the address 44 and postage 46.

In FIG. 2*c*, a sectional view of the first preferred embodiment the surface ES is formed with a coating(s) or treatment(s) 52*b* laid over the image 48 for protection. There are a number of textured varnishes and other suitable materials that will protect the image 48 and absorb ink.

Figure 2D:
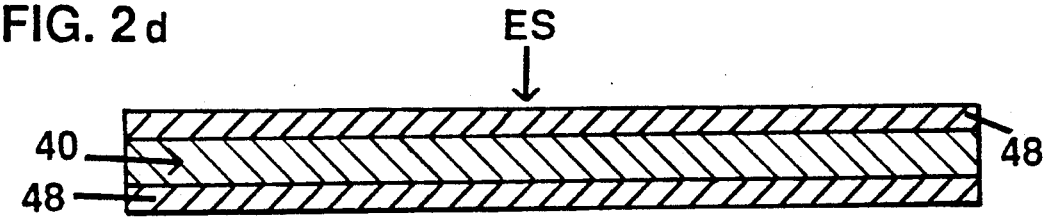

FIG. 2*d* is a sectional view of a similar embodiment. Here, the surface ES lies on the image 48 plane, without any coatings or treatments.

Figure 4C:
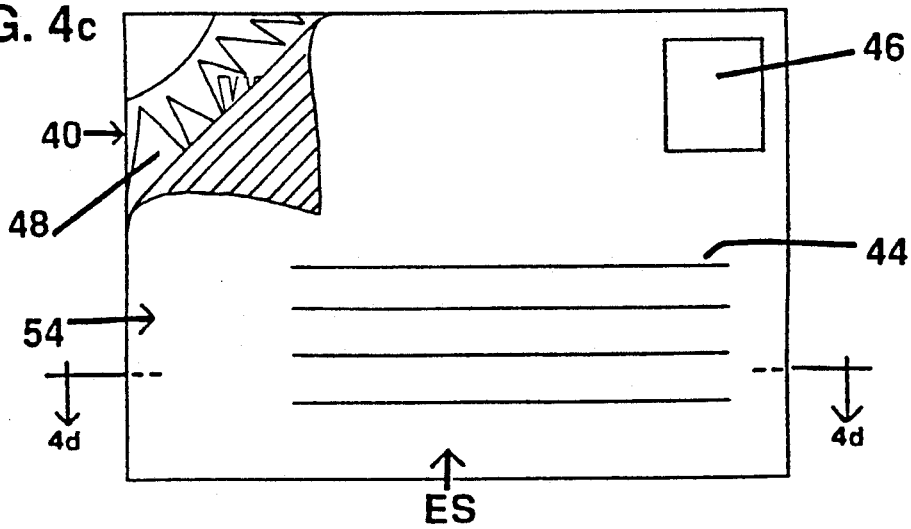
Figure 4D:
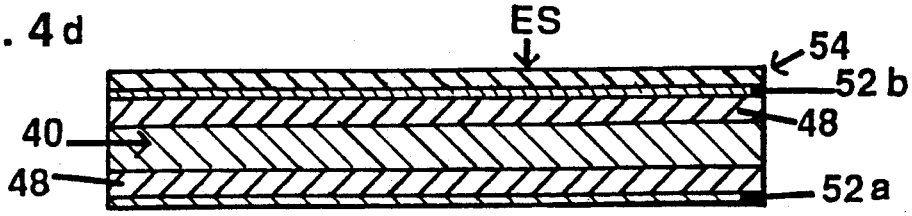

In FIGS. 4*c* (exposed surface) and 4*d* (sectional) views of the third preferred embodiment, the exposed surface ES comprises a label 54 or similar device secured to the card 40. The use of a pressure sensitive type label 54 is preferred; in conjunction with a coating(s) or treatment(s) 52*b* functioning to aid the release of the label 54, thereby protecting the image 48 from defacement. There are several popular treatments for this purpose. The label gives three advantages: it protects the image; it absorbs inks from postal indicia; and it creates an element of surprise for the recipient upon its removal.

The exposed surface ES can also comprise a combination of any of the above forms. For example, FIGS. 3*b* (back) and 3*c* (sectional) show the second preferred embodiment. Here, the surface ES comprises both a label 54 and part of the image 48.

The exposed surface ES has color structured graphics, as hereafter explained; this facilitates the card's passage through light sensitive equipment.

If the exposed surface ES includes a label 54, it may be any number of shapes, sizes, or colors as long as color structure requirements are met.

Method: Color Structured Graphics

Simply imprinting color illustrations on both sides of a card and applying address and postage will not make it suitable for mailing. Indeed such a card will most likely be rejected by the light sensitive equipment employed by the U.S. Postal Service.

The method with which the present invention is made solves this problem by creating an inherent color structure that enables the card to be read by light sensitive equipment.

Figure 5A:
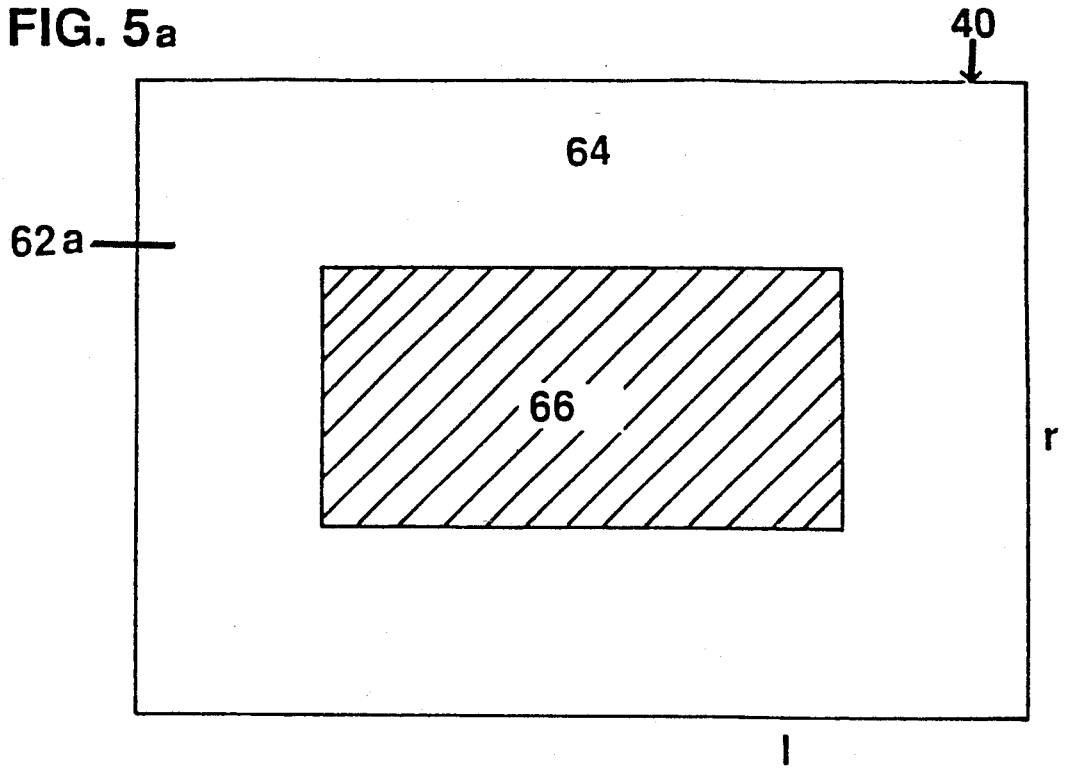
FIGS. 5*a* (front), and 5*b* (back) show the color structure of the invention.
Figure 5B:
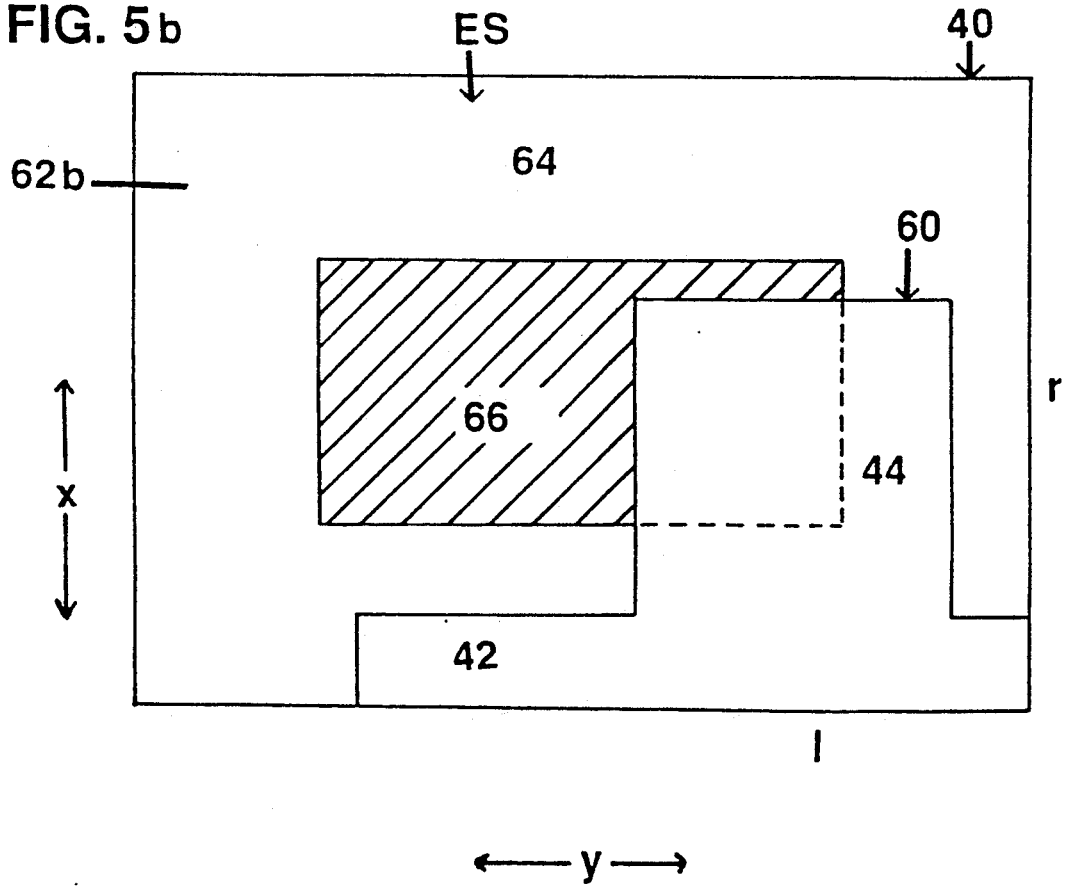

The basic color structure is illustrated in FIGS. 5*a* (front) and 5*b* (back). Creating color structure for the back of the card FIG. 5*b*, comprises the following steps:

(1) Divide the exposed surface ES into four areas, it being understood that the exact dimensions and size relationships of these areas may be changed to suit the needs of a particular use. These areas are:

(a) The critical region 60

The critical region 60 comprises the address block 44 and the bar code area 42. The markings in this region 60 are read by automated light sensitive equipment employed by the Postal Service.

The address block 44 begins 0.5 inches from the right r edge of the card 40 and 0.625 inches from the bottom edge 1 of the card 40. The height x of the address block 44 is between 2.25 inches and 2.75 inches from the bottom 1 of the card 40. The minimum width y of the address block 44 is 2.125 inches from edge r. The width y of block 44 itself may extend up to 7.5 inches; in which case the width of the critical region 60 would also be extended accordingly. Areas directly adjacent to the critical region 60 should be clear of disruptive markings.

The bar code area 42 begins at edge r and extends 4.5 inches. The height x of the bar code area 42 is 0.625 inches beginning at the bottom edge 1 of the card 40.

The light reflectance level(s) of color(s) used in the critical region 60 must be at least 50% in the red part of the optical spectrum, and at least 45% in the green part of the optical spectrum in order for the address and bar code to be properly read for sorting. If several colors are used in the critical region 60, then the print contrast ratio in region 60 should be less than 15%.

Though it is imperative that any color(s) used in region 60 be of the proper reflectance levels mentioned above, it is not necessary for colors in other regions of the card to be of the same reflectance level(s). The optical character reader and bar code scanners key into the critical region 60 of the scanning path to search for specific information; once it has been found the card is moved to its next station.

(b) The non-critical region 62*b*

The non-critical region 62*b* comprises all areas outside of the critical region 60. The non-critical region 62*b* carries the pre-printed verse or greeting, and multicolor graphics. This area 62*b* may contain any number of colors as long as they do not fluoresce; this includes bright and dark colors previously avoided in prior art.

(c) The fluorescence scanning path 64

The fluorescence scanning path 64 extends approximately one and one fourth inches from all four edges of the card body 40. In this path 64, a scanner searches for postage stamps. Postage stamps are made with fluorescent inks.

When the light sensitive equipment scans the mail piece for a stamp, it is actually looking for fluorescent ink. Therefore, if the mail piece requires a stamp, use of fluorescent inks in the fluorescence scanning path 64 will confuse the computer and cause the mail piece to be rejected by the system.

(d) The fluorescence safety region 66

The fluorescence safety region 66 is the area outside of the scanning path 64. The safety region 66 overlaps region 62*b*. In this region 66 fluorescent colors can safely be used. Where the safety region 66 and the critical region 60 overlap, the critical region 60 requirements would take precedence.

Figure 6:
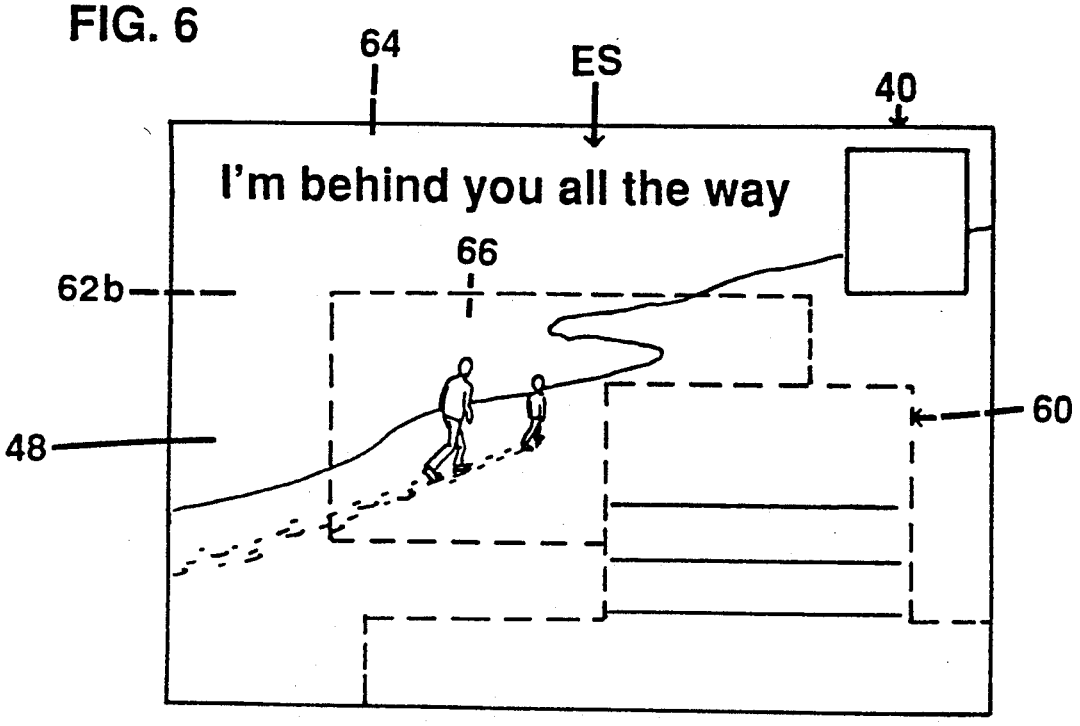
FIGS. 6, 7, and 8 show examples of the latent color structure on the back of the card.
Figure 7:
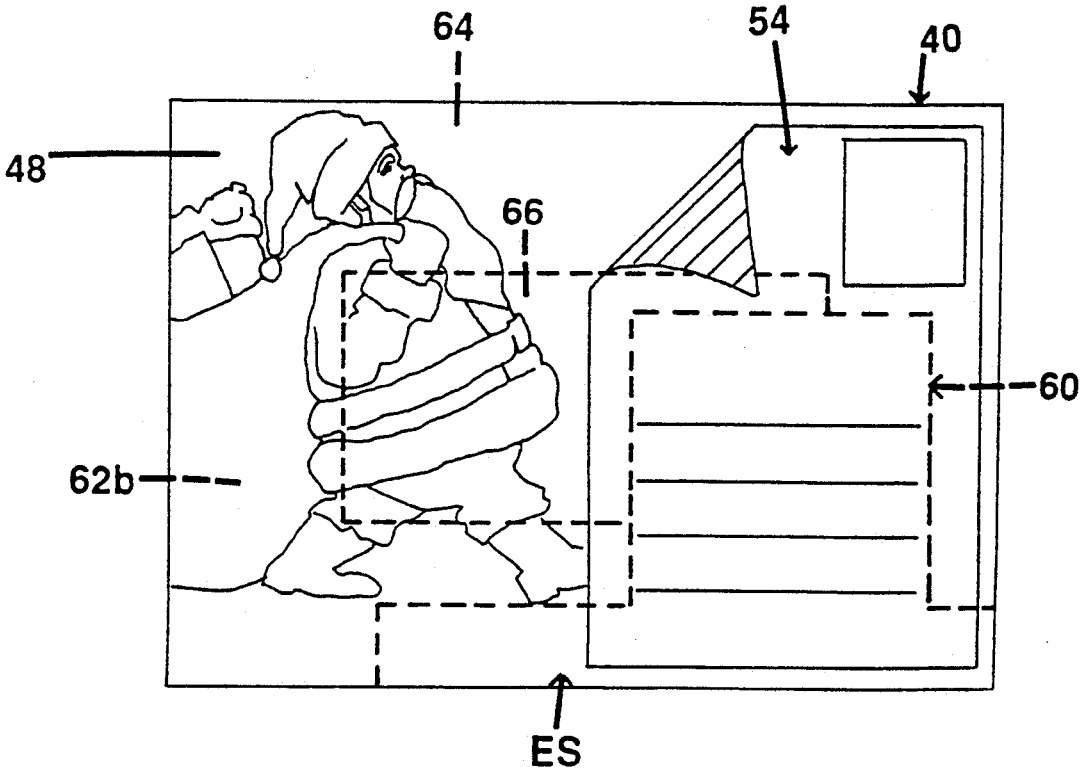
Figure 8:
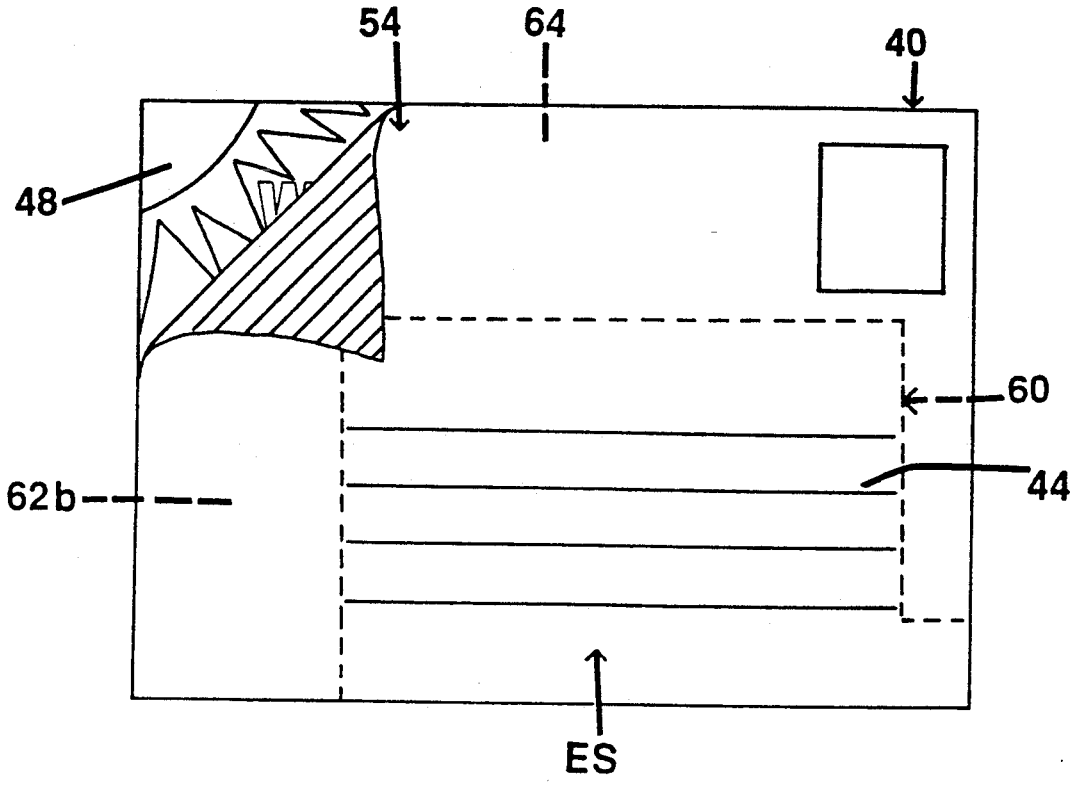

FIG. 6 shows the latent color structure of a multicolor graphic image examined previously. The colors meet the requirements within the appropriate regions.

If the exposed surface has a label(s) 54, then it too must have the appropriate color structure with regard to its location. For example, in FIG. 7 the label 54 overlaps the critical region 60, the non-critical region 62*b*, the fluorescence scanning path 64, and the fluorescence safety region 66. Therefore, any colors used on the label 54 must meet the reflectance and fluorescence requirements for the appropriate regions covered by the label 54. Also shown in FIG. 7, if the label 54 only covers part of the image, then the exposed image 48 must meet the appropriate color structure requirements in its exposed areas.

If the label 54 is opaque, then the parts of the illustration it covers have no color restrictions. For example, in FIG. 8 the label covers the entire graphic image 48 on the back of the card body 40. Therefore, this image 48 may be colored without regard to reflectance restrictions, provided that the label 54 itself is color structured and opaque.

However, if the label 54 is not opaque, and the underlying image 48 shows through, then the show through image 48 must have a print contrast ratio of no more than 15% as seen through the label 54. The address block 44 is wider here, therefore the critical region 60 has been adjusted accordingly.

(2) Design the multi-color graphic images 48 within the regions above, as in FIG. 6.

(3) Select and test colors:

(a) Select colors and inks appropriate for specific regions.

(b) Test light reflectance levels with a light reflectance meter. Check for fluorescence with a luminescence meter or an ultraviolet light.

(c) Adjust and substitute colors as necessary.

It is understood that the exact reflectance and fluorescence requirements may vary with different equipment. The dimensions and color value requirements stated above for the invention, are based on the equipment currently employed by the U.S. Postal Service, and are subject to change.

FIG. 5*a* views the front of the card body 40 and its underlying color structure. This side of the card 40 comprises three regions: the non-critical region 62*a*, the fluorescence scanning path 64, and the fluorescence safety region 66.

If no fluorescent colors are used, this side of the card 40 may be designed as desired.

If fluorescent colors are used, first, create color structure with the following steps:

(1) Divide the card into three areas:

(a) The non-critical region 62*a*

The non-critical region 62*a* encompasses the entire front of the card body 40. Here, any non-fluorescent colors may be used.

(b) The fluorescence scanning path 64

The fluorescence scanning path 64 extends approximately one and one fourth inches from all four edges of the card body 40. No fluorescent colors are used in this path 64.

(c) The fluorescence safety region 66

The fluorescence safety region 66 is the area outside of the scanning path 64. The safety region 66 overlaps region 62*a*. Region 66 may contain fluorescent and non-fluorescent colors.

Figure 9:
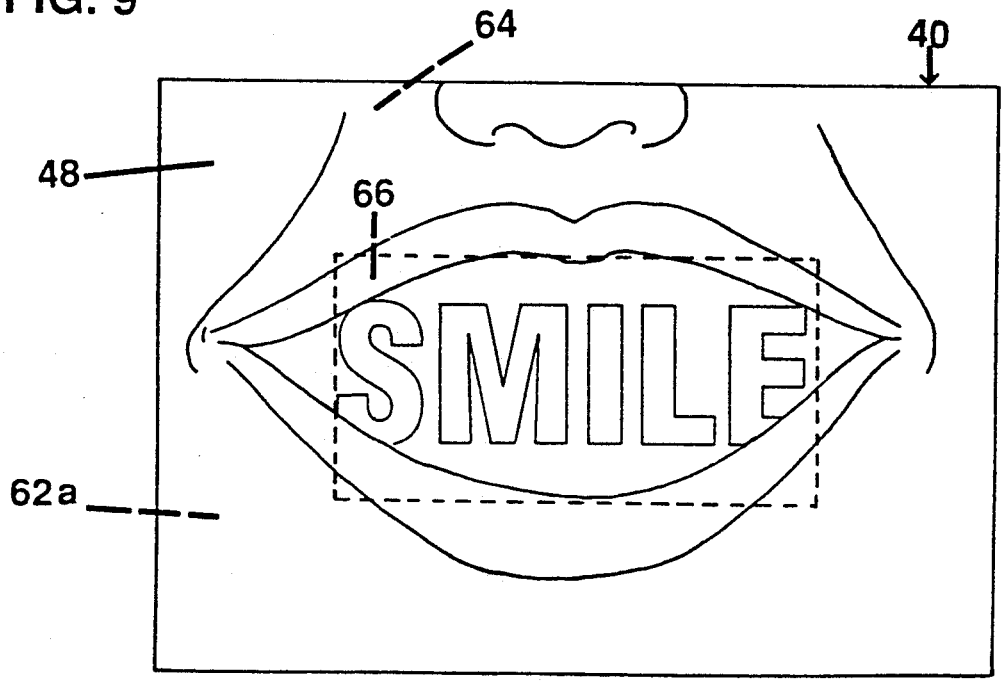
FIG. 9 shows an example of the latent color structure on the front of the card.

(2) Design the multi-color images 48, FIG. 9 serving as an example.

(3) Select and test the desired colors placing fluorescent colors within the safety region 66 only. In FIG. 9 the word SMILE may be printed i fluorescent ink.

The Postal Service currently requires a two hundred line screen minimum for halftones and color separations in order to facilitate proper scanning.

Operation

The operation of the preferred embodiments of the invention comprises three or four steps, depending on the embodiment.

The first preferred embodiment has an exposed surface ES with no label. Other preferred embodiments have an exposed surface ES with a label(s) 54 or similar device. Labels 54 can be pre-attached, partially attached, or non-attached to the card body 40.

Figure 10A:
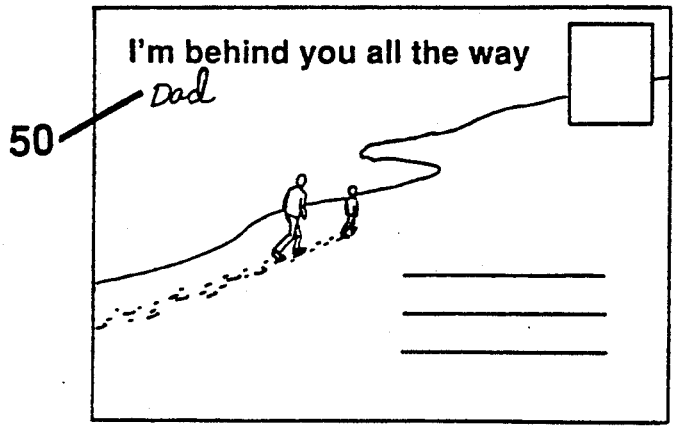
FIGS. 10*a*–10*c* show the steps of operation for certain embodiments.
Figure 10B:
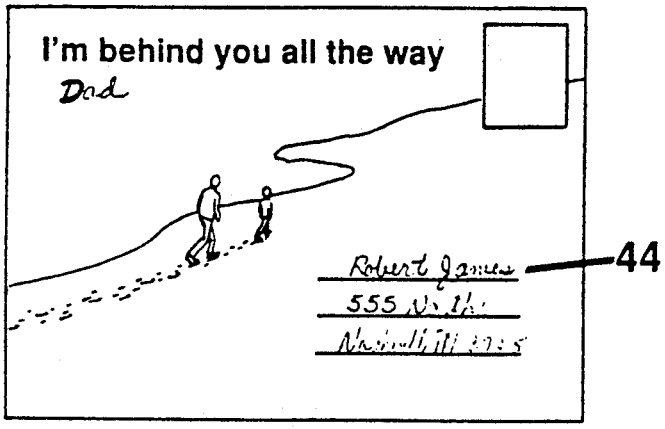
Figure 10C:
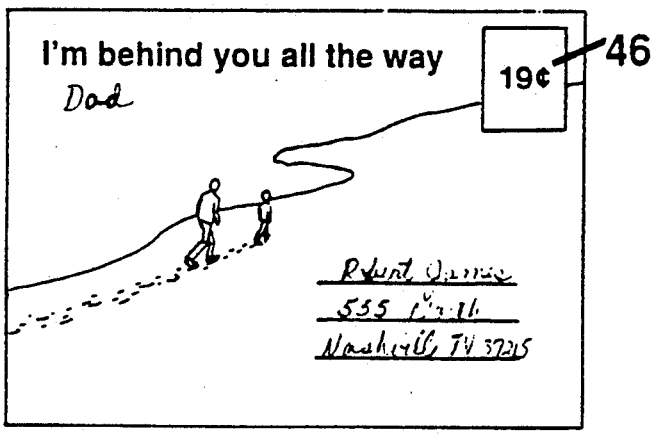
Figure 11A:
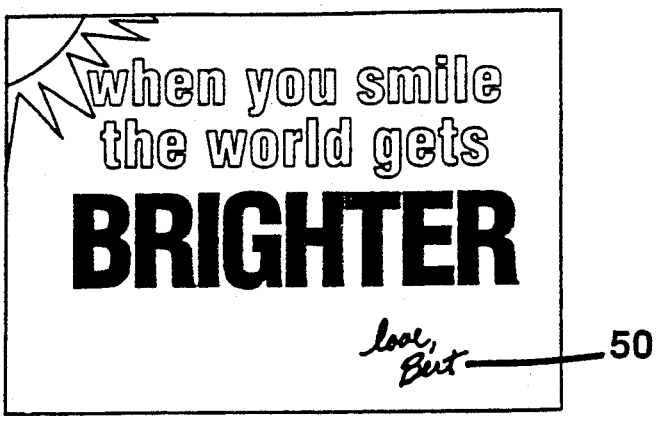
FIGS. 11*a*–11*d* show the steps of operation for other embodiments.
Figure 11B:
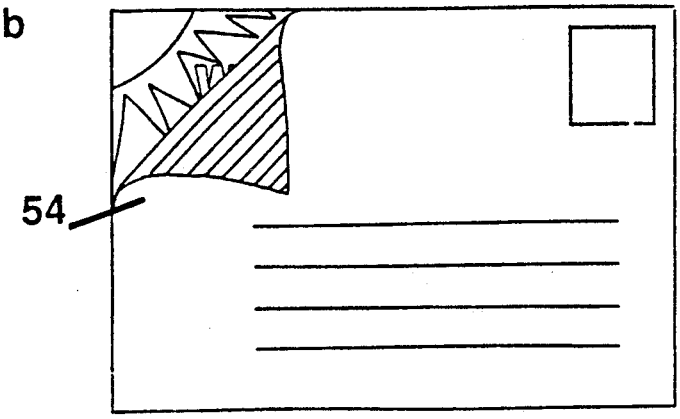
Figure 11C:
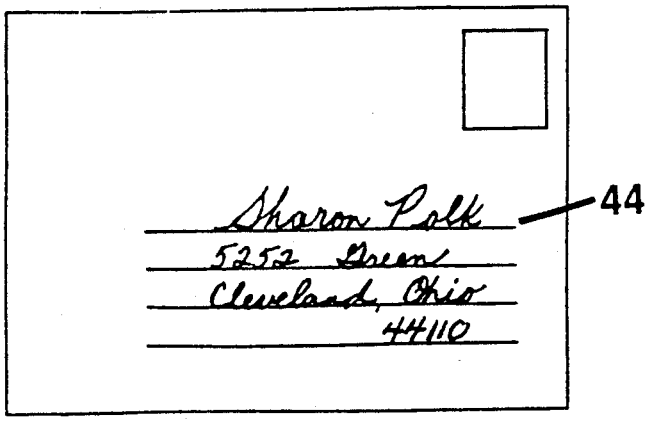
Figure 11D:
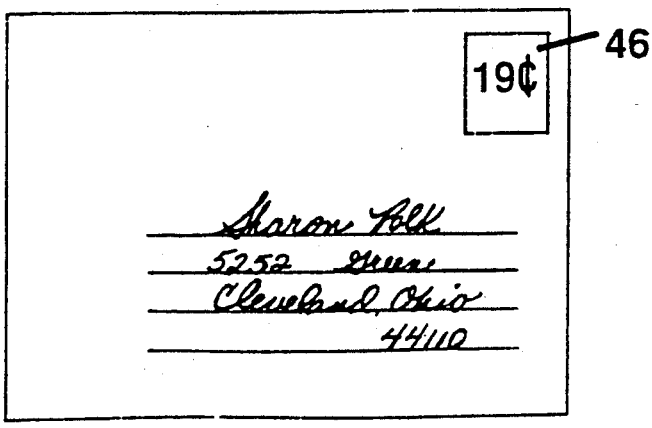

FIGS. 10*a*–10*c* show a three step operation for embodiments of the invention with exposed surfaces having no label or a pre-attached label. In preparing the card for mailing, the sender's steps are as follows:

(1) sign his/her name 50 (optional)

(2) apply recipient's address to area 44

(3) apply the stamp to the area 46

FIGS. 11*a*–11*d* show a four step operation for preferred embodiments with exposed surfaces having partially attached labels or non-attached labels. The sender's steps of operation are:

(1) sign his/her name 50 (optional)

(2) seal the label 54

(3) apply the recipient's address to area 44

(4) apply the stamp to area 46

For preferred embodiments with removable labels, the recipient would remove the label 54 before reading the card. For other preferred embodiments, the recipient would simply read the card.

SUMMARY, RAMIFICATIONS, AND SCOPE

The preferred embodiments of the invention are social expression cards that can be purchased at a fraction of the cost of a greeting card, and can be mailed at the rate of a post card. This invention saves consumers money. The invention is of particular value to consumers with limited incomes, particularly the young and the elderly. The invention is of particular value to consumers who want to send more cards at holiday times, but find the rising costs of cards and postage prohibitive.

The invention is a single panel communication card that does not require some sort of correspondence or written message. This invention saves consumers time and effort. Instead of thinking up something to write, the sender simply selects the card that expresses his own sentiments.

The invention can be prepared for mailing in less time than other commercially sold mailing cards. There are only three or four short steps of operation; depending on the embodiment. The steps are:

| | | | | |
|---|---|---|---|---|
| 1) sign | 2) address | 3) stamp; | OR | |
| 1) sign | 2) seal label | 3) address | | 4) stamp |

The invention has particular environmental value, as its manufacture requires less paper than a standard greeting card of comparable size. Less paper means less wastes, as most greeting cards and their envelopes are discarded after one use.

Because of its color structured graphics, the invention can pass through light sensitive equipment successfully. Color Structured graphics make it possible to use bright and dark colors, where prior attempts at using such colors have failed. The use of color on both sides of a mailing card give it a finished look.

Although the description above contains many specificities, these should not be construed as limiting the scope of the invention but as merely providing illustrations of some of the presently preferred embodiments of this invention. For example, the cards could have other shapes and dimensions; the identifying indicia could be the name of the sender or recipient, as the card could be placed on a gift or transferred by hand. In other embodiments the exposed surface could take any number of forms. For example, it could be a separate entity designed to enclose the card; this is not a preferred embodiment because it would require more paper and postage, however, it could be useful for consumers who want to enclose an item with the card. The invention could be used to enhance learning skills, the social expressions being examined by teacher and pupil or parent and child; here, the exposed surface would not be necessary.

The color method or color structured graphics described above can be applied to any kind of mail piece or other matter that must be read by light sensitive equipment.

It is to be understood that further modifications may be made which will be obvious to those of ordinary skill in the art. Therefore, I do not limit myself to the precise constructions herein disclosed and the right is reserved to all changes and modifications coming within the scope of the invention as defined by the appended claims.

I claim:

1. A communication vehicle comprising:
a sheet of card stock material,
said sheet having no fold,
said sheet having a front face and a back face;
multi-color graphics having a unified theme of social expression applied to said front face and said back face,
said graphics being the principal means of communication,
said back face having a critical region constituting an area reserved for the insertion of identifying indicia, and
means integral with said back face for reflecting light directed at said critical region, said means having reflective properties adequate to reflect light at a level sufficient to comply with postal regulations.

2. A communication vehicle as defined in claim 1 wherein said means for reflecting light is a panel attached to said sheet.

3. A communication vehicle as defined in claim 1 wherein said back face has a predetermined area for, which area is free of any fluorescent coloring.

4. A communication vehicle as defined in claim 1 wherein said critical region is created by a label releasably attached to said sheet by tacky adhesive.

5. A communication card comprising
a card body having no fold,
said card body having a front side and a back side,
multi-color graphic images of social expression applied to both front and back sides of said card body,
said images being the principal means of communication between two parties, and said graphics on said back side having a critical region comprising an area reserved for addressee indicia, means on said card body for reflecting light directed at said critical region, said means reflecting light at a level that complies with Postal Service regulations or at a level(s) that is sufficiently acceptable to the Postal Service to cause said card's successful transference through the mail, and a non-critical region located outside said critical region wherein light reflective levels may be less than those necessary to comply with Postal Service regulations.

6. A card as defined in claim 5 wherein said graphics are treated with a protection means.

7. A card as defined in claim 5 wherein said social expression is selected from the group consisting of relationships, feelings, sentiments, beliefs, greetings, salutations, congratulations, thoughts, wishes, events, occasions, holidays, stories, series of happenings, activities, and commentaries.

8. A card as defined in claim 5 wherein said critical region is on the back face of said card body and includes an area free of any indicia with would interfere with bar code information.

9. A card as defined in claim 5 comprising a scanning path on either the front or back of the card, and path occupying the area(s) in which indicia created and employed by the postal service to facilitate the handling of mailed materials may be placed, said path being free from graphics that would interfere with the detection of said indicia by the automatic sensing equipment of the postal service.

10. A card as defined in claim 9 wherein said path has a predetermined area for postage which predetermined area contains no fluorescent colors.

11. A card as defined in claim 9 wherein said path surrounds an area with contains fluorescent colors.

12. A card as defined in claim 5 wherein said card complies with the regulations prescribed by the U.S. Postal Service as to size, weight, and stiffness.

13. A card as defined in claim 5 wherein said means for reflecting light is created by a label attached to said card body, said label being any number of sizes, shapes, and colors.

14. A card as defined in claim 13 wherein said label has a release means, whereby said label may be removed by the recipient without defacing the underlying image.

15. A multi-color mail piece capable of being read by light sensitive equipment comprising
a mail material bearing an exposed surface, said exposed surface having predetermined areas for address and postage, a critical region on said exposed surface comprising the address block and bar code area, wherein color(s) used complies with the U.S. Postal Service regulations a non-critical region on said exposed surface comprising all areas outside of said critical region, wherein any non-fluorescent coloring is used, a fluorescence scanning path on said exposed surface comprising the area scanned by an imprint or postage detector, wherein non-fluorescent coloring is used, a fluorescence safety region on said exposed surface comprising the area outside of said fluorescence scanning path and said critical region, wherein fluorescent coloring is used if desired.

16. A multi-color mail piece as in claim 15 further including a face located opposite to said exposed surface, a non-critical region on said face comprising all areas of said face, wherein non-fluorescent coloring is used, a fluorescence scanning path on said face comprising the area scanned by an imprint or postage detector, wherein non-fluorescent coloring is used, a fluorescence safety region on said face comprising the area outside of said fluorescence scanning path wherein fluorescent coloring is used if desired.

17. A mail piece as in claim 15 wherein said piece is a card measuring no less than 3.5 inches by 5 inches or the minimum card size required by the U.S. Postal Service.

18. A mail piece as in claim 17 wherein said mail piece is a single panel social expression card comprising a card body having no fold, imprinted graphic images on both front and back sides of said card, said images symbolizing or representing a theme selected from the group consisting of relationships, feelings, sentiments, beliefs, greetings, salutations, congratulations, thoughts, wishes, events, stories, occasions, holidays, series of happenings, activities, and commentaries, said images being the principal means of communication between two parties.

19. A mail piece as claimed in claim 15 wherein said exposed surface includes a label.

20. A post card including a single sheet of card stock material, said sheet being of a size and shape prescribed by U.S. Postal Service regulations to require minimum postage, said sheet having a front and back, both the front and back of said sheet having a perimeter boarder, said perimeter boarder being devoid of any graphics which would interfere with the ability of automated equipment to sense the existence of postage applied within said perimeter boarder, an addressee section on either the front or back of the sheet which section is of a size, shape and location that complies with the postal service regulations specifying the size and location of the addressee panel of a post card, said addressee section being devoid of any graphics which would interfere with the ability of automated optical character readers to read the address of the recipient of the card placed in the said section, and graphics having a unified theme of social expression applied to the front and back of said card.

21. A card as defined in claim 20 wherein the graphics are multi-colored.

22. A card as defined in claim 20 wherein the graphics are the principal means of communication.

23. A card as defined in claim 20 wherein the addressee section is created by a label attached to said card.

24. A card as defined in claim 23 wherein said label covers at least a portion of the graphics.

25. A card defined in claim 23 wherein said label is adhered to said card by a tacky adhesive which will allow the label to be removed from the card without destroying the graphics.

26. An improved post card comprising a sheet of mail material, said sheet having a front face and a back face;

graphics constituting an artistic representation of relationships, thoughts or feelings, said graphics serving as the principal means of communication between the sender and the recipient of the card;

said graphics dominating the front face and the back face of the sheet;

the dominance of said graphics substantially eliminating the traditional space designated for correspondence, thereby functioning to obviate the social obligation of personal correspondence created by said space without causing offense to the recipient, said graphics further functioning to increase the speed and ease with which the sending party may communicate with others;

said back face having a critical region constituting an area reserved for identifying indicia; and the light reflective level(s) of color(s) used in the critical region being acceptable to the postal service.

27. A card as defined in claim 26 having a print contrast ratio in the critical region of less than 15%.

28. A card as defined in claim 26 wherein said sheet of mail material has a perimeter and a fluorescent scanning path around said perimeter which fluorescent scanning path complies with the requirements of the U.S. Postal Service.

29. A card as defined in claim 26 wherein said graphics are multi-colored.

30. A card as defined in claim 26 wherein said mail material is formed with at least one layer of card stock.

31. A card as defined in claim 26 wherein the light reflective level(s) of color(s) used in the critical region are at least 50% in the red part of the optical spectrum and at least 45% in the green part of the optical spectrum.

32. A communication vehicle as defined in claim 26 wherein said artistic representation expresses sentiments selected from the group consisting of beliefs, greetings, salutations, congratulations, thoughts, wishes, events, occasions, holidays, stories, series of happenings, activities, commentaries, spirituality, religions, jokes, humor, people, and places.

33. An improved consumer mailing card including a single panel mail material, said panel having a front face and a back face, multi-color graphic images applied to said front face and said back face, said back face having a critical region available for the insertion of identifying indicia, means integral with the back face of said material for reflecting light directed at said critical region, and said means having reflective properties adequate to reflect light at a level(s) sufficient to comply with Postal Service regulations or at a level(s) that is sufficient to cause the panel to be accepted by the Postal Service as evidenced by its passage through the mail service provided by the Postal Service.

34. A card as defined in claim 33 wherein said back face has a predetermined area for postage.

35. A card as defined in claim 33 wherein said means for reflecting light is attached to said panel.

36. A card as defined in claim 35 wherein said means for reflecting light comprises a label releasably attached to said panel by tacky adhesive.

37. A card as defined in claim 33 wherein said images are unified themes of social expression.

38. A card as defined in claim 37 wherein said social expressions are selected from the group consisting of relationships, feelings, sentiments, beliefs, greetings, salutations, congratulations, thoughts, wishes, events, occasions, holidays, stories, series of happenings, activities, commentaries, spirituality, religions, jokes, humor, people, and places.

39. A card as defined in claim 33 wherein said critical region further comprises an area free of any indicia that would interfere with bar code data imprinted thereon.

40. A card as defined in claim 33 wherein the colors of the multi-color graphic images are selected from the group consisting of any individual hue, shade, tint or pigment; any shade of the spectrum or variation of the same; as well as any shade of black, white, or gray.

41. A card as defined in claim 40 wherein multi-color graphic images include two (2) or more colors, or the perception of two or more colors.

42. A card as defined in claim 33 wherein said images function as the principal means of communication between a sending party and a receiving party.

43. A card as defined in claim 33 wherein said mail material comprises at least one layer of card stock formed of sufficient thickness for mailing.

* * * * *

UNITED STATES PATENT AND TRADEMARK OFFICE

CERTIFICATE OF CORRECTION

PATENT NO. : 5,316,345

DATED : May 31, 1994

INVENTOR(S) : Roberta E. Madison

It is certified that error appears in the above-indentified patent and that said Letters Patent is hereby corrected as shown below:

Column 1, line 23, change the word "who" to --whom--.

Column 1, line 41, change the word "wastes" to --waste--.

Column 1, line 46, change the word "wastes" to --waste--.

Column 1, line 62, add the word --In-- before "U.S.".

Column 5, line 46, add a comma after the word "embodiment".

Column 8, line 22, change "i" to --in--.

IN THE CLAIMS:

Column 10, line 7, add the word --postage-- after the word "for".

Column 10, line 41, change the word "with" to --which--.

Column 10, line 44, change the word "and" to --said--.

Column 10, line 55, change the word "with" to --which--.

Column 11, line 54, change the word "boarder" to --border--.

Column 11, line 57, change the word "boarder" to --border--.

UNITED STATES PATENT AND TRADEMARK OFFICE

CERTIFICATE OF CORRECTION

PATENT NO. : 5,316,345

DATED : May 31, 1994

INVENTOR(S) : Roberta E. Madison

It is certified that error appears in the above-indentified patent and that said Letters Patent is hereby corrected as shown below:

Column 12, line 53, change the words "communication vehicle" to --card--.

Signed and Sealed this

Twentieth Day of December, 1994

*Attest:*

Bruce Lehman

BRUCE LEHMAN

*Attesting Officer*

*Commissioner of Patents and Trademarks*